US009663954B1

(12) United States Patent
Fernandez

(10) Patent No.: US 9,663,954 B1
(45) Date of Patent: May 30, 2017

(54) INTERLOCKING ROOF CEMENT PAVER AND METHOD TO MANUFACTURE

(71) Applicant: Jorge Pablo Fernandez, Medley, FL (US)

(72) Inventor: Jorge Pablo Fernandez, Medley, FL (US)

(73) Assignee: Jorge Pablo Fernandez, Miami Beach, FL (US)

( * ) Notice: Subject to any disclaimer, the term of this patent is extended or adjusted under 35 U.S.C. 154(b) by 0 days.

(21) Appl. No.: 15/210,647

(22) Filed: Jul. 14, 2016

(51) Int. Cl.

| | |
|---|---|
| ***E04D 1/04*** | (2006.01) |
| ***E04D 1/34*** | (2006.01) |
| ***E04D 1/36*** | (2006.01) |
| ***E04D 15/02*** | (2006.01) |
| ***B28B 3/02*** | (2006.01) |

(52) U.S. Cl.
CPC ..... *E04D 1/04* (2013.01); *B28B 3/021* (2013.01); *E04D 1/34* (2013.01); *E04D 1/36* (2013.01); *E04D 15/02* (2013.01)

(58) Field of Classification Search
CPC .... E04D 1/04; E04D 1/34; E04D 1/36; E04D 15/02; B28B 3/021
See application file for complete search history.

(56) References Cited

U.S. PATENT DOCUMENTS 196,773 A * 11/1877 Stripe
1,255,280 A * 2/1918 Beck ..... E04F 13/0864 52/519
1,386,554 A * 8/1921 Dalglish ..... E04C 2/043 52/591.4
1,427,968 A * 9/1922 Pedersen ..... E04D 1/04 52/533
2,211,508 A * 8/1940 Little ..... E04F 13/12 52/521
3,775,925 A * 12/1973 Fujita ..... E04D 1/28 52/534
4,172,346 A * 10/1979 Kuroiwa ..... E04C 2/06 52/408
4,899,514 A * 2/1990 Brookhart, Jr. ..... E04D 11/00 52/535
5,404,687 A * 4/1995 Blake ..... E04B 1/944 52/1
5,900,203 A * 5/1999 Needham ..... B29C 70/086 264/248
5,928,735 A * 7/1999 Padmanabhan ..... B32B 21/08 428/297.4

(Continued)

*Primary Examiner* — Jeanette E Chapman
(74) *Attorney, Agent, or Firm* — Christian Sanchelima

(57) ABSTRACT

The present disclosure discloses an interlocking roof tile comprising two groove extending over length of the interlocking roof tile at both lateral ends that create side walls at the distalmost ends of the interlocking roof tile. The grooves are created on top surface of the interlocking roof tile using a press machine that uses pressure to mold the cement into the interlocking roof tiles. The interlocking roof tile's at bottom surface is flat. The interlocking roof tile further comprises at least one nail opening, provided spatially from each other to mount and secure the interlocking roof tile to the roof. In order to couple a plurality of interlocking roof tiles in series, a first interlocking roof tile is placed coupled to the second roof tile such that side wall of the first interlocking roof tile is engaged with the groove of the second interlocking roof tile.

7 Claims, 5 Drawing Sheets

(56) References Cited

U.S. PATENT DOCUMENTS

| | | | | |
|---|---|---|---|---|
| 6,519,905 | B1 * | 2/2003 | Knighton | B32B 37/24 108/10 |
| 9,109,363 | B2 * | 8/2015 | Grau | E04C 2/30 |
| 9,453,346 | B2 * | 9/2016 | Yau | E04C 2/12 |
| 2003/0046891 | A1 * | 3/2003 | Colada | B28B 1/002 52/518 |
| 2004/0123544 | A1 * | 7/2004 | Simmons | B28B 7/0082 52/519 |
| 2012/0317913 | A1 * | 12/2012 | Esquivel | B28D 1/18 52/311.2 |
| 2013/0326989 | A1 * | 12/2013 | Hartert | B27M 3/04 52/578 |

* cited by examiner

FIG. 2
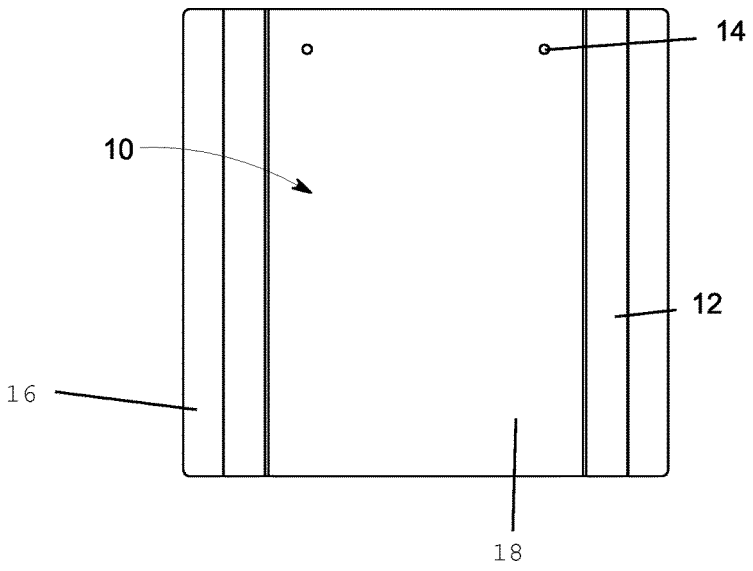
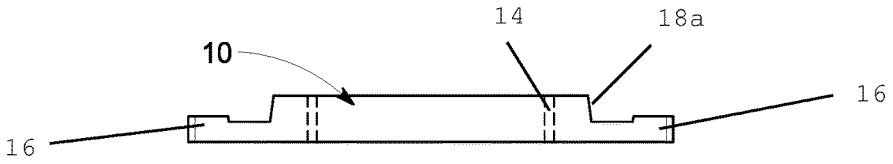
FIG. 3
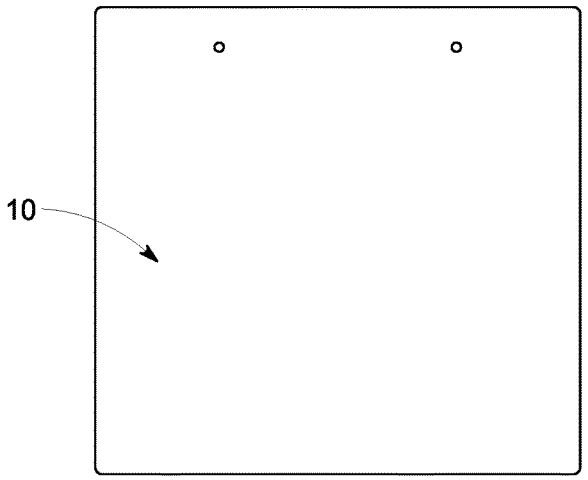
FIG. 4

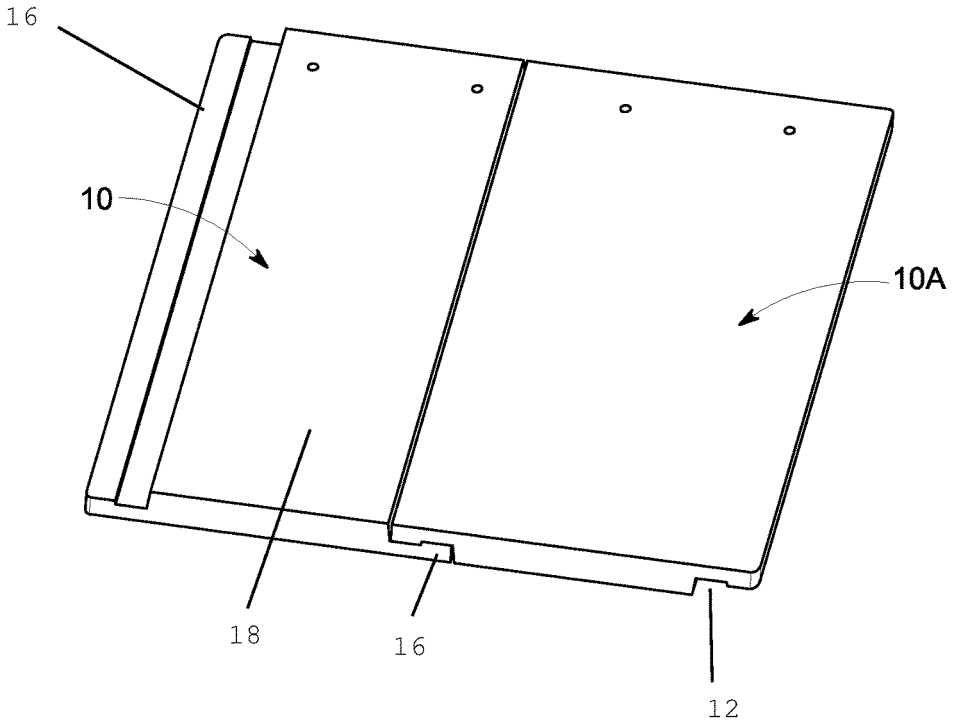
FIG. 7
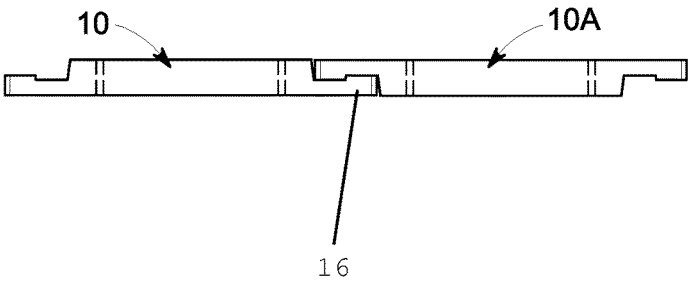
FIG. 8
FIG. 9
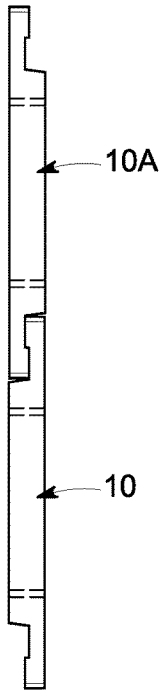

INTERLOCKING ROOF CEMENT PAVER AND METHOD TO MANUFACTURE

BACKGROUND OF THE INVENTION

1. Field of the Invention

The present disclosure generally relates to roof tiles. More particularly, the present disclosure discloses a roof tile comprising grooves extended at both ends on top surface of the roof tile.

2. Description of the Related Art

As known, roof tiles have been used since ancient times. The roof tiles may be formed of rigid or flexible material. Generally, a plurality of roof tiles is attached in series by driving a fastener, such as a roofing nail, through the roof tile. Typically, the roof tiles are provided with extended grooves at both ends of the roof tile. Particularly, the grooves are provided at top left side of the roof tile, and at bottom right side such that a plurality of roof tiles is placed in series to cover the roof.

Several designs for roof tiles have been designed in the past. Applicant believes that a related reference corresponds to U.S. Pat. No. 7,003,922 issued to Westile, Inc. filed on Nov. 22, 2001 for interlocking roof tiles. However, it differs from the present invention because the presenting invention includes interlocking functionality using roof tiles made of cement material that includes the novel way to interlock the tiles and provide nail openings to further secure the tiles to a rooftop. Nail openings on a roof tile is novel and non-obvious method to mount the tiles thereon. In addition, the method to manufacture the roof tiles made of a cement material requires for a novel and non-obvious implementation. Namely, the tiles must be pressed instead of extruded and manufactured under intense pressure. Also, the nail openings must be done in a particular manner as to not destroy the integrity of their function. Useful improvements were required to accomplish this method.

In one aspect of the present disclosure, a roof tile comprising groove extending over length of the roof tile at both ends is disclosed. The grooves are provided on top surface of the roof tile. The roof tile, at bottom comprises a flat surface. The roof tile further comprises at least one nail opening, provided spatially from each other on top surface of the roof tile. The nail openings are provided to mount and secure the roof tile to roof. The plurality of roof tiles is coupled using the grooves provided on top surfaces of the roof tiles. In other words, a first roof tile is coupled to the second roof tile such that top surface of the first roof tile faces upwards and second roof tile faces bottom surface to interlock two roof tiles. In another aspect of the present disclosure, a method of manufacturing the roof tile is disclosed.

The features and advantages described in this summary and in the following detailed description are not all-inclusive, and particularly, many additional features and advantages will be apparent to one of ordinary skill in the relevant art, in view of the drawings, and specification thereof. Moreover, it should be noted that the language used in the specification has been principally selected for readability and instructional purposes, and may not have been selected to delineate or circumscribe the inventive subject matter.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an interlocking roof tile made of cement.

It is another object of this invention to provide an interlocking roof tile made of cement having openings to allow it to be secured to a roof.

It is still another object of the present invention to provide a method of manufacturing such a roof tile out of cement having openings to secure it to a roof.

It is yet another object of this invention to provide such a tile and method that are inexpensive to implement and maintain while retaining their effectiveness.

BRIEF DESCRIPTION OF DRAWINGS

In the following drawings, like reference numbers are used to refer to like elements. Although the following figures depict various examples of the invention, the invention is not limited to the examples depicted in the figures.

FIG. 2 illustrates a top plan view of the present invention.

FIG. 3 illustrates a see-through side elevational view of an interlocking roof tile, in accordance with one embodiment of the present disclosure showing nail openings 14.

FIG. 4 is a bottom view of an interlocking roof tile, in accordance with one embodiment of the present disclosure;

FIG. 7 illustrates an isometric view of coupling two roof tiles, in accordance with one embodiment of the present disclosure;

FIGS. 8 and 9 illustrate side views of the roof tiles coupled and placed in horizontal and vertical position, in accordance with one embodiment of the present disclosure.

DETAILED DESCRIPTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses an interlocking roof tile made of a cement material (similar to a paver) and comprising grooves extending over the length of the roof tile at both lateral ends. The grooves are provided on the top surface of the interlocking roof tile. The interlocking roof tile includes a flat bottom surface. The interlocking roof tile further includes at least two nail openings, spaced apart from each other on the interlocking roof tile's top surface. The nail openings are provided to mount and secure the interlocking roof tile to a roof. Nail openings can be configured to cooperate with nails, screws or similar fastening means.

In order to connect a plurality of interlocking roof tiles in series, the interlocking roof tiles are placed one after another on the roof. Specifically, the plurality of interlocking roof tiles are coupled together using the grooves provided on the top surfaces of the roof tiles. In other words, a first roof tile is coupled to the second roof tile such that top surface of the first interlocking roof tile faces upwards and second interlocking roof tile faces downwards and engages the first interlocking roof tile, thus aligning the channels and allowing an interlock. Further, the pattern repeats with each joining tile being upside down relative to the one its joining to.

Figure 1:
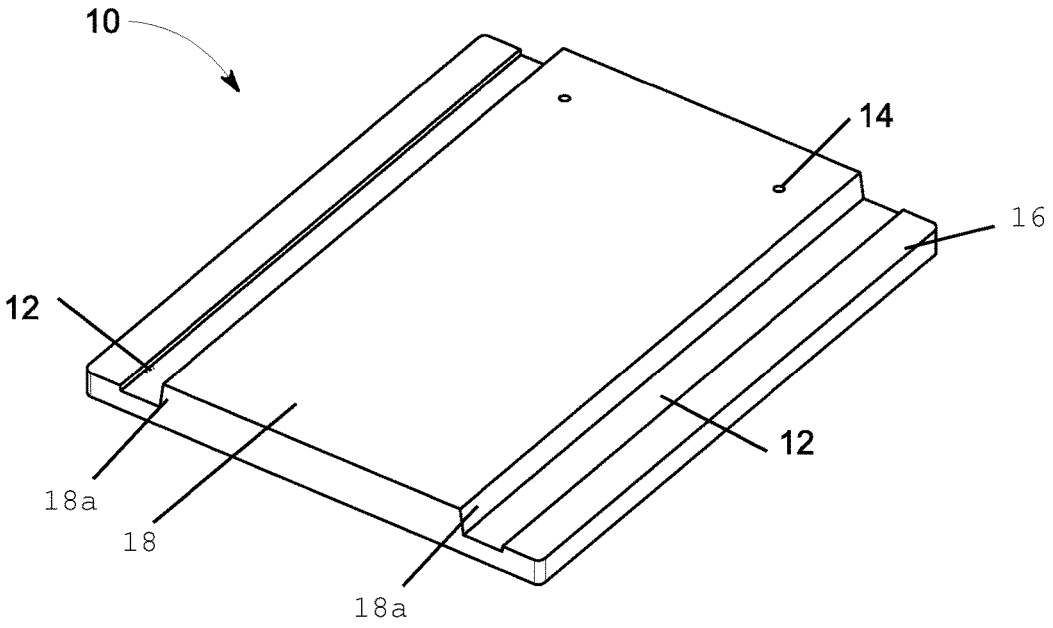
FIG. 1 shows an isometric view of the cement interlocking roof tile having grooves 12, nail openings 14, side walls 16, top surface 18, and inner walls 18*a*.
Figure 5:
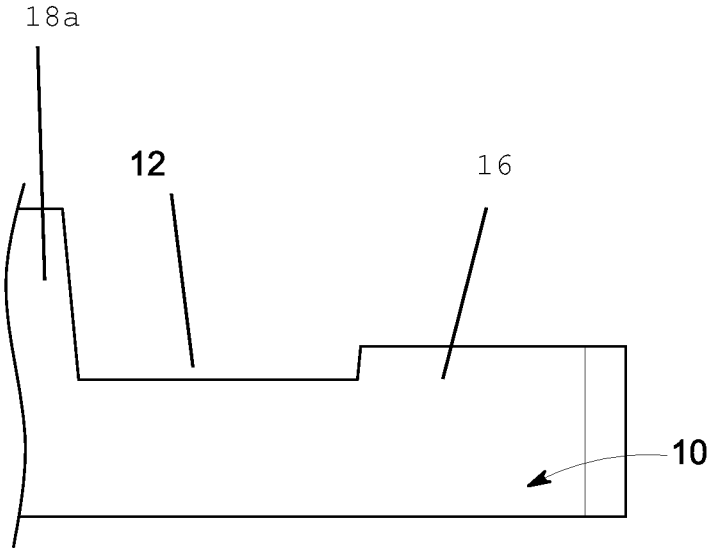
FIG. 5 illustrates exploded view of a groove 12 and a side wall 16 at one distalmost end of the cement interlocking roof tile, in accordance with one embodiment of the present disclosure.
Figure 6:
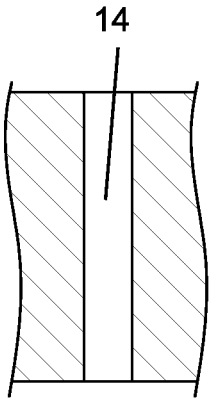
FIG. 6 illustrates cross-sectional view of a nail opening, in accordance with one embodiment of the present disclosure.
Figure 10:
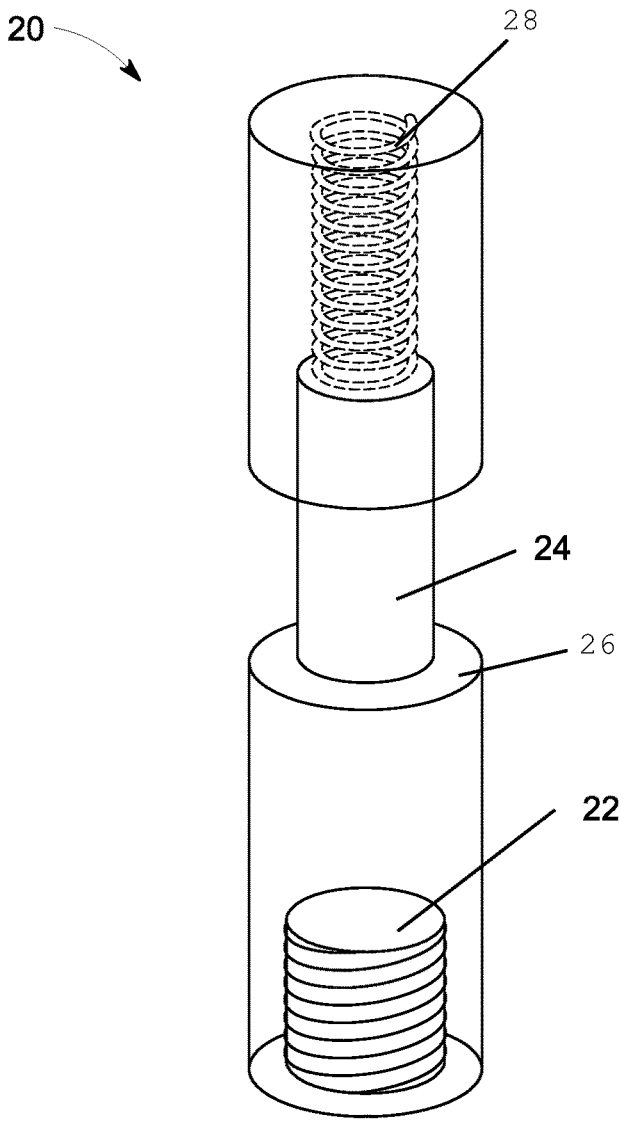
FIG. 10 illustrates a shock absorbing member 24 having rod 22 partially passed therein towards bottom surface 26 as it finishes punching nail opening, in accordance with one embodiment of the present disclosure.

In addition, other joining mechanisms are used to secure the roof tile to roof. The various features and embodiments of the roof tile are explained in conjunction with the description of FIGS. 1-7. The grooves being recessed within the interlocking roof tiles create two elevated side walls at both distalmost ends of the interlocking roof tiles' top surface. These elevated side walls are used when interlocking roof tiles are coupled to prevent them from sliding away from each other, thereby creating a more secure engagement than any roof tiles currently found in the prior art.

Referring now to the drawings where interlocking roof file 10 includes grooves 12 provided at both ends of the roof tile 10. Grooves 12 are extended longitudinally over the length of the interlocking roof tile 10 at both lateral ends as shown in FIG. 2. Further, the roof tile 10 comprises at least one nail opening 14 provided on the top surface. It should be understood more than one nail opening 14 may be provided on the top surface of the roof tile 10 to provide additional support to secure the roof tile 10 to the roof. Nail opening 14 can be a throughhole that traverses the entire thickness of the cement interlocking roof tile 10 and can be configured to cooperate with nails, screws, bolts or similar engagement means commonly understood to mount a roof tile to a roof. The construction features of grooves 12 and nail openings 14 are explained in subsequent portion of the description. Interlocking roof tile, as shown in FIG. 1A also includes top surface 18 that has inner wall 18*a* extending therefrom. Inner wall 18*a* can extend from top surface 18 in a right angle, obtuse angle or acute angle relationship.

As can be seen from FIG. 3A, grooves 12 are provided at the top surface of the interlocking roof tile 10. Further, bottom surface is flat and does not include grooves 12. The constructional features of grooves 12 and the nail openings 14 are explained using FIG. 3-FIG. 5. As can be seen from FIG. 4, the grooves 12 are made at both lateral ends of the interlocking roof tile 10. In order to make grooves 12, the interlocking roof tile 10 is punched or pressed to remove material therefrom. Specifically, grooves 12 are punched such that the width of each portion can be the same or different from one another depending on the type of interlock required. In other words, grooves 12 can manufactured into different dimensions. The first groove can include a width greater than the second groove.

In one embodiment, grooves 12 are pressed so that side walls 16 are created to be perpendicularly extending from each of the grooves 12 towards the distalmost ends of interlocking roof tile 10. Side walls 16 can be manufactured to have varying angles with respect to grooves 12 depending on the type of engagement needed. The side walls 13 allow for a more secure engagement between the interlocking roof tiles 10 since they cannot slide apart. Side walls 16 then in this capacity act as a stopper to prevent the disengagement of the interlocking roof tiles leading to an attachment stronger than any currently found in the market.

In one implementation, the nail opening 14 may be punched through the entire thickness of interlocking roof tile 10. In other implementation, the nail opening 10 may be punched substantially through the width of the roof tile 10. The nail opening 14 is provided on the interlocking roof tile 10 to secure it to the roof. In one example, a nail may be put through the nail opening to secure the roof tile 10 to the roof. Alternatively, any known mechanical mechanisms or adhesives may be used to secure the interlocking roof tile 10 to the roof.

A second roof tile 10A is interlocked with the first interlocking roof tile 10, by placing the second roof tile 10A downward as shown in FIG. 6A. In other words, the first interlocking roof tile 10 is placed facing up and the second roof tile 10A is placed adjacent to the first roof tile 10 facing down. The side walls 16 of the first interlocking roof tile are engaged into the grooves 12 of the second interlocking roof tile 10A. The first interlocking roof tile 10 and the second roof tile 10A can be locked together by holding them in sideways at 90 degrees. As the first interlocking roof tile 10 and the second roof tile 10A are locked together with the help of grooves 12 and side walls 13, the use of adhesives, nails or any other mechanical means to attach the two tiles is avoided. Due to the structure of grooves 12, two roof tiles are interlocked with greater strength. When the two or more roof tiles are placed in series, the roof tiles can withstand pressure applied from various angles. FIGS. 6B and 6C shows the first roof tile 10 and the second roof tile 10A after interlocking in horizontal and vertical position.

In order to manufacture the cement interlock roof tile 10, a press machine may be used. The press machine 20 may be used in various shapes depending on the shape of groove 12 or the nail opening 14. The press machine can create the cement interlocking roof tile 10 by using intense pressure as opposed to extrusion. This is an important distinction over the present state of the art that does not use cement for roof tiles. Using cement allows lowers the expense associated with the creation of roof tiles as well as enhances their strength.

Press machine creates grooves 12 as well as side walls 16 and includes hole-punching assembly (not shown) that can receive rod 22 to punch nail openings 14. The rod 22 is further inserted into a shock absorber assembly 20 that includes adapter 24. The shock absorbing member 24 may act as a shock absorber when the rod 22 is used to punch nail openings 14 so that rod 22 can be passed completely through the thickness of interlocking roof tile 10 without damaging the press machine when it exits its opposite side. In other words, the shock absorbing member 24 is used to ensure that a fully penetrating hole is produced. As rod 22 enters shock absorbing member 24 it comes in abutting contact with a bottom surface 26 that is spring-loaded using spring member 28 to absorb the force from rod 22. As grooves 12, resulting side walls 13, and nail openings 14 are made using the press machine, loss of material is reduced as the cement interlocking roof tile 10 is molded. Use of the press machine allows interlocking roof tile 10 made of cement material to be reliable for a longer duration due to the higher compressive tolerance it is subjected to during manufacturing.

The plurality of roof tiles is used reciprocally to interlock one another in series. The interlocking of the roof tiles provides a stronger connection between the roof tiles. The roof tiles can withstand greater amount of pressure from various angles. As the roof tiles are stronger, durable and are also backward compatible, the roof tiles can be installed using conventional building materials. Further, the roof tiles are coupled without use of adhesive or any other mechanical means. Due to the roof tiles being manufactured with materials similar to the dwellings the same material to make the dwellings can be used leading to a more efficient build. Furthermore, greater tolerance levels can be achieved during installation. The interlocking roof tiles are mounted to each other in a way that enough of one interlocking roof tile overlaps with the other so that neither water nor debris can enter and compromise their integrity. Similarly, side walls 16 assist in creating a seal to prevent water or debris to enter and jeopardize the roof.

In the preceding specification, the present disclosure is described with reference to the specific embodiments. However, it will be apparent to a person with ordinary skill in the art that various modifications and changes can be made, without departing from the scope of the present disclosure. Accordingly, the specification and figures are to be regarded as illustrative examples of the present disclosure, rather than in restrictive sense. All such possible modifications are intended to be included within the scope of present disclosure.

What is claimed is:

1. An interlocking roof tile system comprising a cement interlocking roof tile having a flat top surface, a flat bottom surface and two lateral ends, said top surface having two adjacent grooves each extending longitudinally at each lateral end along the length of said interlocking roof tile, said top surface has an inner wall between it and each of said grooves, said grooves facing said direction being recessed within said cement interlocking roof tile to define two side walls and two inner walls extending perpendicularly from said grooves, said side walls located on the distalmost lateral ends of said interlocking roof tile, a second cement interlocking roof tile includes the same components as the first interlocking roof tile, said first and second interlocking roof tiles having said side walls that engage the other tile's said grooves and encompass the entire space within said groove to create a secure engagement when said side walls enter said grooves, said first interlocking tile's side wall is nested between said inner wall and said side wall, additional cement tiles having the same components are subsequently connected in series to each other under the roof project is completed, said top surface on each of said roof tiles having at least one nail opening of a dimension that cooperates with fastening means that fastens said interlocking roof tiles to a roof, said top surface on each of said roof tiles being flush to one another when said tiles are engaged.

2. The interlocking roof tile system subject of claim 1 wherein said fastening means are nails.

3. The interlocking roof tile system subject of claim 1 wherein said fastening means are screws.

4. The interlocking roof tile system subject of claim 1 wherein said side walls of said interlocking roof tiles are or a width large enough that when said interlocking roof tiles are mounted to each other there is sufficient overlap to create a water seal.

5. The interlocking roof tile system subject of claim 1 wherein said side walls extend from said grooves in an obtuse angle.

6. The interlocking roof tile system subject of claim 1 wherein two nail openings are used to secure said cement interlocking roof tile to a roof.

7. The interlocking roof tile system subject of claim 1 wherein said cement interlocking roof tile is made of a mix of concrete.

* * * * *